US009681250B2

(12) United States Patent
Luo et al.

(10) Patent No.: US 9,681,250 B2
(45) Date of Patent: Jun. 13, 2017

(54) STATISTICAL MODELLING, INTERPOLATION, MEASUREMENT AND ANTHROPOMETRY BASED PREDICTION OF HEAD-RELATED TRANSFER FUNCTIONS

(71) Applicant: University of Maryland, College Park, MD (US)

(72) Inventors: Yuancheng Luo, College Park, MD (US); Ramani Duraiswami, Highland, MD (US); Dmitry N. Zotkin, Greenbelt, MD (US)

(73) Assignee: University of Maryland, College Park, College Park, MD (US)

( * ) Notice: Subject to any disclaimer, the term of this patent is extended or adjusted under 35 U.S.C. 154(b) by 234 days.

(21) Appl. No.: 14/120,522

(22) Filed: May 27, 2014

(65) Prior Publication Data

US 2015/0055783 A1 Feb. 26, 2015

Related U.S. Application Data

(60) Provisional application No. 61/827,071, filed on May 24, 2013.

(51) Int. Cl.
*H04S 7/00* (2006.01)
*H04S 5/00* (2006.01)

(52) U.S. Cl.
CPC ..... *H04S 7/303* (2013.01); *H04S 5/00* (2013.01); *H04S 7/304* (2013.01); *H04S 2400/15* (2013.01); *H04S 2420/01* (2013.01)

(58) Field of Classification Search
None
See application file for complete search history.

(56) References Cited

U.S. PATENT DOCUMENTS

2009/0150126 A1* 6/2009 Sellamanickam ..... G06N 7/005 703/2

OTHER PUBLICATIONS

Raykar et al, "Extracting the frequencies of the pinna spectral notches in measured head related impulse responses." pp. 1-11. Apr. 6, 2005.*
Candela et al, "A unifying view of sparse approximate Gaussian process regression." pp. 1-21. Dec. 2005.*
PCT International Search Report and Written Opinion for PCT/US2014/000136 dated Oct. 27, 2014.
(Continued)

*Primary Examiner* — Curtis Kuntz
*Assistant Examiner* — Qin Zhu
(74) *Attorney, Agent, or Firm* — Foley & Lardner LLP

(57) ABSTRACT

A system for generating and outputting three-dimensional audio data using head-related transfer functions (HRTFs) includes a processor configured to perform operations comprising: using a collection of previously measured HRTFs for audio signals corresponding to multiple directions for at least one subject; performing non-parametric Gaussian process hyper-parameter training on the collection of previously measured HRTFs to generate one or more predicted HRTFs that are different from the previously measured HRTFs; and generating and outputting three-dimensional audio data based on at least the one or more predicted HRTFs.

19 Claims, 10 Drawing Sheets

(56) References Cited

OTHER PUBLICATIONS

Romigh, Individulaized Head-Related Transfer Functions: Efficient Modeling and Estimation from Small Sets of Spatial Samples, http://search.proquest.com/docview/128 9081356 (Dec. 2012).
Hinton, Reducing the Dimensionality of Data with Neural Networks, Science, vol. 313, No. 5786, pp. 504-507 (Jul. 2006).
Morioka et al., Adaptive Modeling of HRTFs Based on Reinforcement Learning, Field Programmable Logic and Application, Springer Berlin Heidelberg, vol. 7666, pp. 423-430 (Jan. 2012).
Huang et al., Modeling personalized head-related impulse response using support vector regression, Journal of Shanghai Univ., vol. 13, No. 6, pp. 428-432 (Dec. 2009).

* cited by examiner

STATISTICAL MODELLING, INTERPOLATION, MEASUREMENT AND ANTHROPOMETRY BASED PREDICTION OF HEAD-RELATED TRANSFER FUNCTIONS

CROSS-REFERENCE TO RELATED APPLICATION

This application claims the benefit of, and priority to, U.S. Provisional Patent Application Ser. No. U.S. 61/827,071 filed on May 24, 2013, entitled "STATISTICAL MODELLING, INTERPOLATION, MEASUREMENT AND ANTHROPOMETRY BASED PREDICTION OF HEAD-RELATED TRANSFER FUNCTIONS", by Luo et al, the entire content of which is hereby incorporated by reference.

GOVERNMENT SUPPORT

This invention was made with United States (U.S.) government support under IS1117716, awarded by the National Science Foundation (NSF), and N000140810638, awarded by the Office of Naval Research (ONR). The U.S. government has certain rights in the invention.

BACKGROUND

1. Technical Field

The present disclosure relates to the interpolation or measurement of Head Related Transfer Functions (HRTFs). More particularly, the present disclosure relates to specific methods to the analysis of HRTF data from collections of measured or computed data of HRTFs.

2. Background of Related Art

The human ability to perceive the direction of a sound source is partly the result of cues encoded in the sound reaching the eardrum after scattering off of the listener's anatomic features (torso, head, and outer ears). The frequency response of how sound is modified in phase and magnitude by such scattering is called the Head-Related Transfer Function (HRTF) and is specific to each person. Knowledge of the HRTF allows for the reconstruction of realistic auditory scenes.

While the ability to measure and compute HRTFs has existed for several years, and HRTFs of human subjects have been collected by different labs, there remain several issues with their widespread use. First, HRTFs show considerable variability between individuals. Second, each measurement facility seems to use an individual process to obtain the HRTF using varying excitation signals, sampling frequencies, and more importantly measurement grids. The latter is a larger problem than may be initially thought, as the measurement grids are neither spatially uniform nor high resolution; time/cost issues and peculiarities of each measurement apparatus are limiting factors. FIG. 1 illustrates a typical HRTF measurement grid. To overcome the grid problem, solutions via spherical interpolation techniques are either performed on a per-frequency basis or in a principal component weight space over the measurement grid per subject. Yet another problem is that often measured HRTFs for a subject are not available, and the HRTFs need to be personalized to the subject. Personalization in a tensor-product principal component space has been attempted.

A key development in statistical modeling has been the development of Bayesian methods, which learn from available data, and allow the incorporation of informative prior models. If HRTFs can be jointly modeled in their spatial-frequency domain under a Bayesian setting, then it might be possible to improve the ability to deal with these issues. Moreover, such a modeling can be done in an informative feature space, as is often done in speech-processing and image-processing. Spectral features (such as peaks and notches) are promising and correlate listening cues along specific directions (median plane) to anatomical features.

SUMMARY

The embodiments of the present disclosure relate to a system for statistical modelling, interpolation, and user-feedback based inference of head-related transfer functions (HRTF) including a tangible, non-transitory memory communicating with a processor, the tangible, non-transitory memory having instructions stored thereon that, in response to execution by the processor, cause the processor to perform operations comprising: using a collection of previously measured head related transfer functions for audio signals corresponding to multiple directions for at least one subject; and performing Gaussian process hyper-parameter training on the collection of audio signals.

In one embodiment, the operation of performing Gaussian process hyper-parameter training on the collection of audio signals may further include causing the processor to perform operations that include: applying sparse Gaussian process regression to perform the Gaussian process hyper-parameter training on the collection of audio signals.

In one embodiment, the system further includes causing the processor to perform an operation that includes: for requested HRTF test directions not part of an original set of HRTF test directions, inferring and predicting an individual user's HRTF using Gaussian progression; and calculating a confidence interval for the inferred predicted HRTF and, in one embodiment, extracting extrema data from the predicted HRTF.

In one embodiment, the system further includes causing the processor to perform an operation that includes: accessing the collection of HRTF to provide a data base of HRTF for autoencoder (AE) neural network (NN) learning; and learning an AE NN based on the collection of HRTF accessed; and generating low-dimensional bottleneck AE features.

In one embodiment, the system further includes causing the processor to perform an operation that includes: generating target directions; computing sound-source localization errors reflecting an argument; and accounting for the sound-source localization errors in a global minimization of the argument of the sound-source localization errors (SSLE).

In one embodiment, the system further includes causing the processor to perform an operation that includes: decoding the argument of the sound-source localization errors to a HRTF.

In one embodiment, the system further includes causing the processor to perform an operation that includes: performing a listening test utilizing the HRTF; reporting a localized direction as feedback input; recomputing the SSLE; and re-performing the global minimization of the argument of the SSLE.

In one embodiment, the system further includes causing the processor to perform an operation that includes: based upon the performing Gaussian hyper-parameter training on the collection of audio signals to generate at least one predicted HRTF performed utilizing the multiple HRTF measurement directions, based upon the decoding of the argument of the SSLE to a HRTF, based upon performing a listening test utilizing the HRTF, and based upon reporting a localized direction as feedback input, generating a Gaussian process listener inference.

In one embodiment, the operation of collecting audio signals for at least one subject further comprises causing the processor to perform operations that include, given HRTF measurements from different sources, creating a combined predicted HRTF.

In one embodiment, the system further includes causing the processor to perform an operation that includes: accessing the database collection of HRTF for the same individual; accessing from the database HRTF measurements in multiple directions; and accessing a database of HRTF test directions.

In one embodiment, the system further includes causing the processor to perform an operation that includes: based on the accessing steps, implementing Gaussian process inference.

In one embodiment, the system further includes causing the processor to perform an operation that includes: generating predicted HRTF and confidence intervals.

The present disclosure relates also to a method for statistical modelling, interpolation, measurement and anthropometry based prediction of head-related transfer functions (HRTF) for a virtual audio system that includes: collecting audio signals in transform domain for at least one subject; applying head related transfer functions (HRTF) measurement directions in multiple directions to the collected audio signals; and performing Gaussian hyper-parameter training on the collection of audio signals to generate at least one predicted HRTF.

In one embodiment, the method may further include causing the processor to perform an operation that includes: identifying the individual associated with the predicted HRTF.

In one embodiment, the method may further include, wherein the step of performing Gaussian hyper-parameter training on the collection of audio signals further comprises applying sparse Gaussian process regression to perform the Gaussian hyper-parameter training on the collection of audio signals.

In one embodiment, the method may further include applying HRTF test directions: and inferring Gaussian progression virtual listener measurements.

In one embodiment, the method may further include predicting an HRTF for the at least one individual; and calculating a confidence interval for the predicted HRTF.

In one embodiment, the method may further include extracting extrema data from the predicted HRTF.

BRIEF DESCRIPTION OF THE DRAWINGS

These and other advantages will become more apparent from the following detailed description of the various embodiments of the present disclosure with reference to the drawings wherein:

FIG. 1 is a schematic representation of a possible HRTF measurements set up according to prior art, and whose data the present disclosure takes advantage of;

DETAILED DESCRIPTION

The embodiments of the present disclosure relate to a non-parametric spatial-frequency HRTF representation based on Gaussian process regression (GPR) that addresses the aforementioned issues. The model uses prior data (HRTF measurements) to infer HRTFs for previously unseen locations or frequencies for a single-subject. The interpolation problem between the input spatial-frequency coordinate domain $(\omega,\theta,\phi)$ and the output HRTF measurement $H(\omega,\theta,\phi)$ is non-parametric but does require the specification of a covariance model, which should reflect prior knowledge. Empirical observations suggest that the HRTF generally varies smoothly both over space and over frequency. In the model, the degree of smoothness is specified by the covariance model; this property also allows us to extract spectral features in a novel way via the derivatives of the interpolant. While the model can utilize the full collection of HRTFs belonging to the same subject for inference, it can also specify any subset of frequency-spatial inputs to jointly predict HRTFs at both original and new locations. Learning a subset of predictive HRTF directions as well as covariance function hyperparameters is an automatic process via marginal-likelihood optimization using Bayesian inference—a feature that other methods do not possess. HRTF data from the CIPIC database [Algazi et al., "THE CIPIC HRTF DATABASE" IEEE Workshop on Applications of Signal Processing to Audio and Acoustics 2001, 21-24 Oct. 2001, New Paltz, N.Y., pages W2001-1 to W2001-41] are used in the interpolation, feature extraction, and importance sampling experiments. HRTFs from other sources could also be used instead, or in addition to this data. Further, features based on modern dimensionality reduction techniques such as autoencoding neural networks may be useful.

Figure 1:
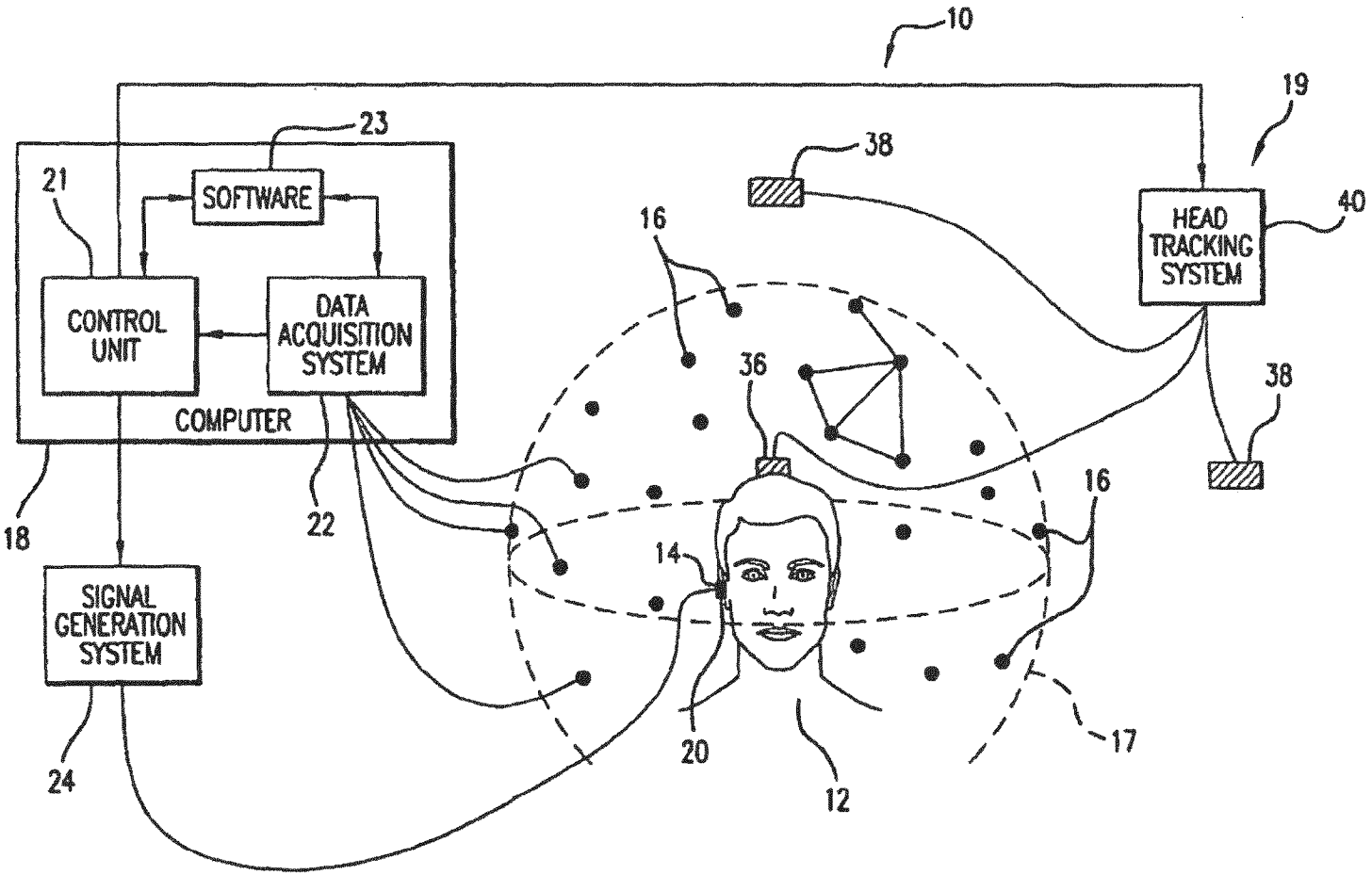
FIG. 1 (Prior Art)

FIG. 1 illustrates a method of collecting data for the generation of a Head Related Transfer Function (HRTF) of an individual 12 for the purpose of providing a data base to perform the functions of statistical modelling, interpolation, measurement and prediction of HRTFs according to embodiments of the present disclosure. Such a method is described in commonly-assigned U.S. Pat. No. 7,720,229, "METHOD FOR MEASUREMENT OF HEAD RELATED TRANSFER FUNCTIONS", by Duraiswami et al., the entire content of which is hereby incorporated by reference.

As defined herein, a user of the systems and methods of the embodiments of the present disclosure may be a mathematician, statistician, computer scientist, engineer or software programmer or the like who assembles and programs the software to generate the necessary mathematical operations to perform the data collection and analysis. A user may also be a technically trained or non-technically trained individual utilizing an end result of one or more HRTFs generated by systems and methods of the embodiments of the present disclosure to listen to audio signals using a headphone, etc. As defined herein, HRTF measurement refers exclusively to the magnitude part as HRTF can be reconstructed from magnitude response using min-phase transform and pure time delay. In some embodiments, HRTF measurements may be preprocessed by taking the magnitude of the discrete Fourier transform, truncating to 100/200 bins, and scaling the magnitude range to (0,1 (is maximum magnitude for all HRTFs)).

With relation to FIG. 1, there is shown a system 10 for measurement of head related transfer function of the individual 12 to associate that HRTF as the HRTF of that particular individual for the purposes of the statistical modelling, interpolation, and anthroprometry based prediction of HRTFs according to embodiments of the present disclosure. The system 10 includes a transmitter 14, a plurality of pressure wave sensors (microphones) 16 arranged in a microphone array 17 surrounding the individual's head, a computer 18 for processing data corresponding to the pressure waves reaching the microphones 16 to extract Head Related Transfer Function (HRTF) of the individual, and a head/microphones tracking system 19.

The head/microphones tracking system 19 includes a head tracker 36 attached to the individual's head, a microphone array tracker 38 and a head tracking unit 40. The head tracker 36 and the microphone array tracker 38 are coupled to the head tracking system 40 which calculates and tracks relative disposition of the microspeaker 14 and microphones 16.

An alternative embodiment of a HRTF measuring system is one in which microphones are placed in the individual's ears and speakers are employed to generate acoustical signals. Such a system is for instance described in Algazi et al., "THE CIPIC HRTF DATABASE" IEEE Workshop on Applications of Signal Processing to Audio and Acoustics 2001, 21-24 Oct. 2001, New Paltz, N.Y., pages W2001-1 to W2001-4.

The computer 18 serves to process the acquired data and may include a control unit 21, a data acquisition system 22, and software. Alternatively, the computer 18 may be located in separate fashion from the control unit 21 and data acquisition system 22.

Figure 2:
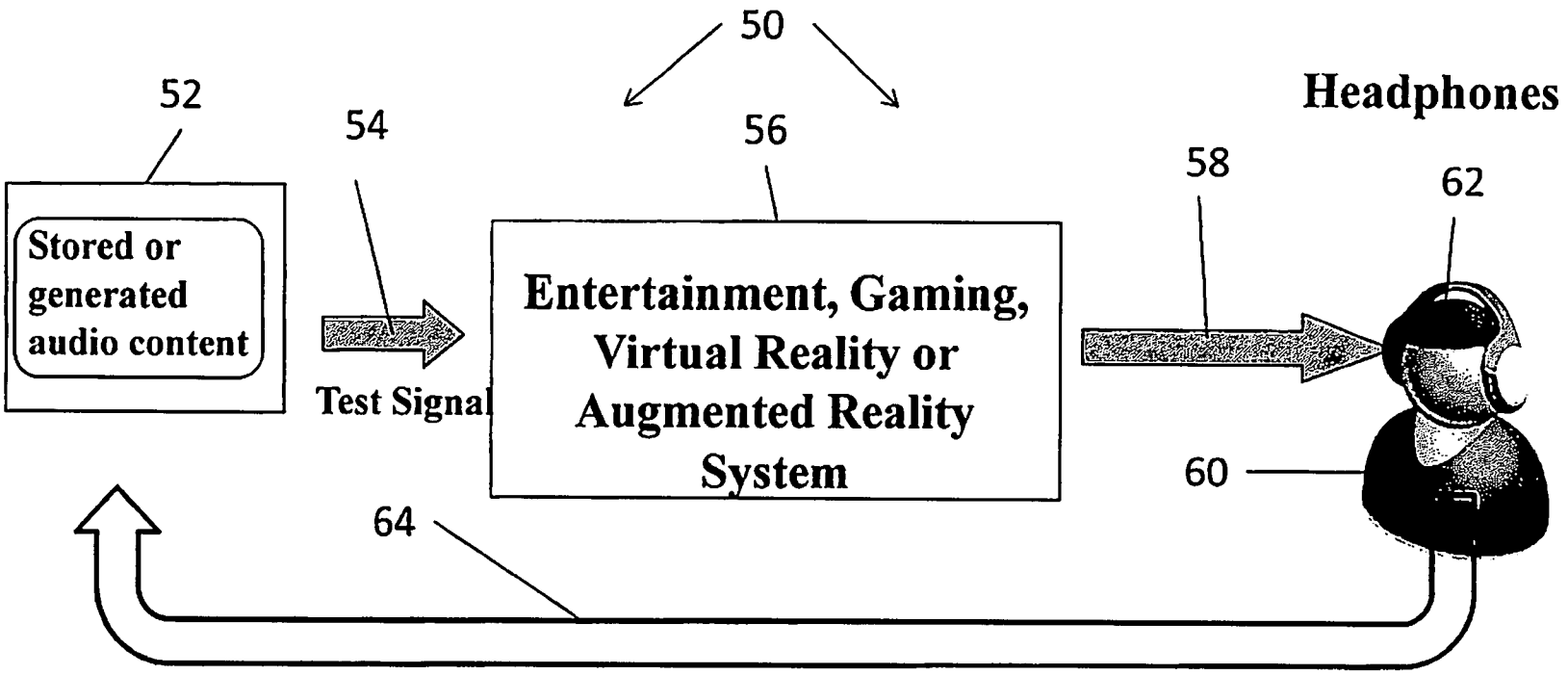
FIG. 2 is a schematic representation of a system in which HRTFs measured via prior art or calculated according to the embodiments of the present disclosure are used for creation of 3D audio content presented over headphones.
Figure 3:
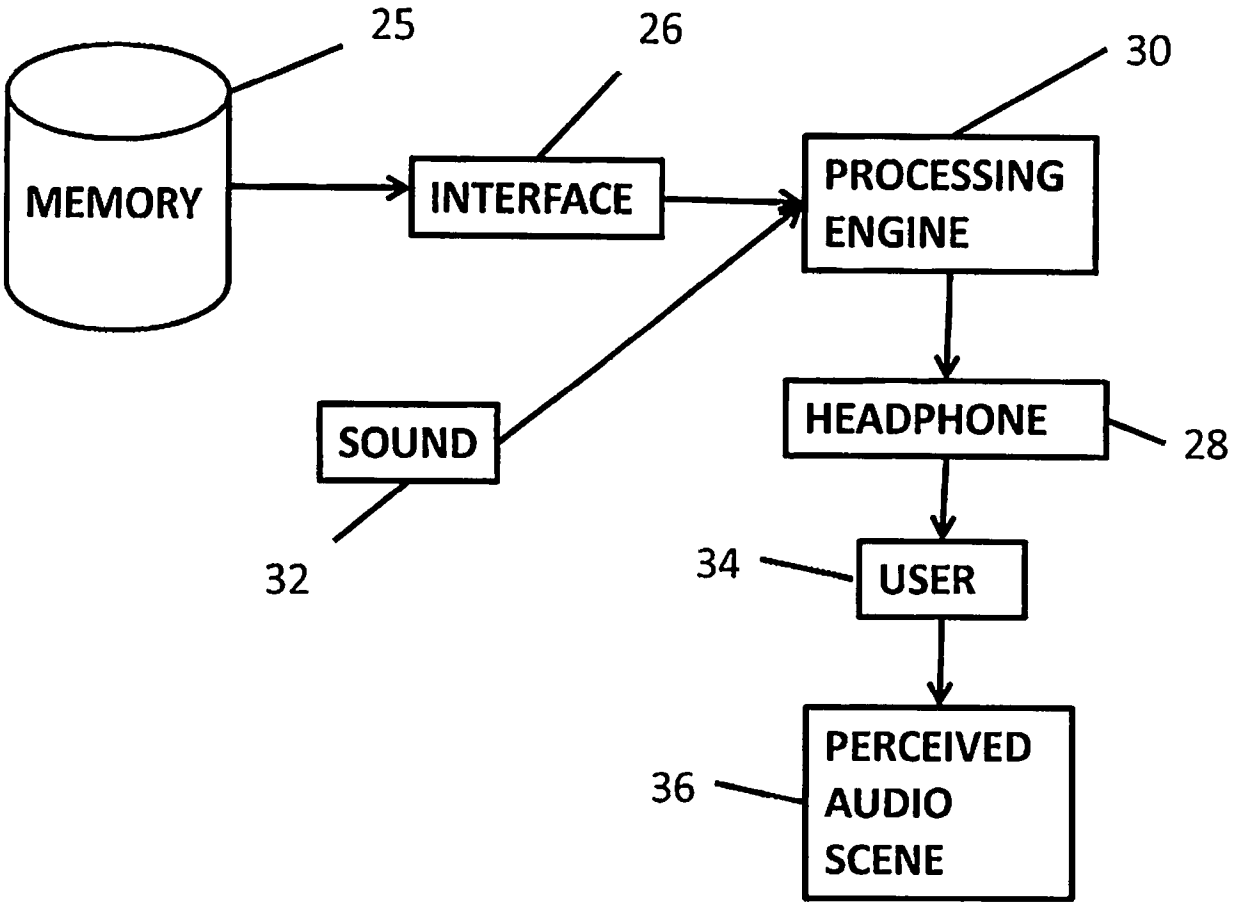
FIG. 3 is a schematic illustration of the employment of a HRTF either measured or calculated according to embodiments of the present disclosure into a memory for processing of a sound into an audio scene via the calculated HRTF.

FIG. 2 is a schematic representation of a system 50 in which HRTFs measured in a system such as system 10 in FIG. 1 or calculated according to the embodiments of the present disclosure are used for creation of 3D audio content presented over headphones. More particularly, system 50 includes stored or generated audio content 52 which is output as a test signal 54 to an entertainment, gaming, virtual reality or augmented reality system 58 which serves as a processing engine that interfaces through interface 58 with an individual 60, who may be the individual 12 in system 10 shown in FIG. 1, via headphones 62. Inferences made relating to the HRTF of individual 60 by the HRTF measurement system 10 of FIG. 1 result in a modified HRTF that is returned to the stored or generated audio content 52 in feedback loop 64 to replace the previously stored content. The individual 60 provides the feedback information for the feedback loop 64 by indicating through a user interface (not shown) where he or she perceives the sound to originate from. After the Head Related Transfer Functions are obtained by HRTF measurement system 10 in FIG. 1, they are stored in a memory device 25, shown in FIG. 3, which further may be coupled to an interface 26 of an audio playback device such as a headphone 28 used to play a synthetic audio scene. A processing engine 30, which may be either a part of a headphone 28, or an addition thereto, combines the Head Related Transfer Functions read from the memory device 25 through the interface 30 with a sound 32 to transmit to a user 34 a perceived sound thereby creating a synthetic audio scene 34 specifically for the individual 60 in FIG. 2. Thus, people such as individual 60 who have their HRTFs measured are a small set of people. On the other hand there may be millions of people such as individual 12 in FIG. 1 playing games, watching movies etc.

Figure 4:
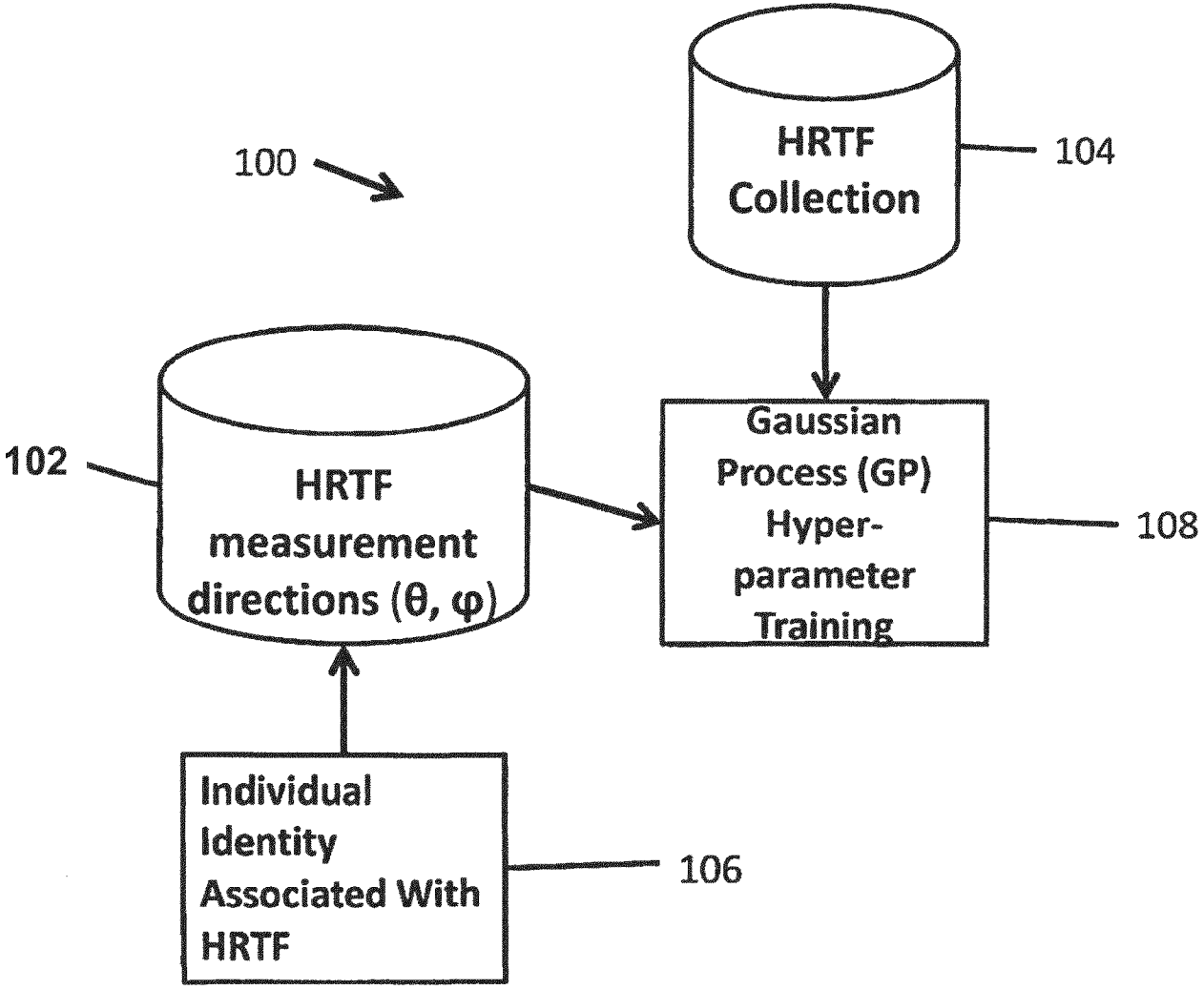
FIG. 4 illustrates a schematic flow chart of a Gaussian process regression method as applied to a collection of head related transfer functions (HRTF) corresponding to several measurement directions from for at least one subject wherein the individual identity of the subject may be associated with the HRTF according to one embodiment of the present disclosure.

FIG. 4 illustrates a schematic flow chart of a Gaussian process regression method 100 as applied to head related transfer functions (HRTF) measurement directions from collections of audio signals in transform domain such as a collection of HRTFs for at least one subject wherein the individual identity of the subject may be associated with the HRTF according to one embodiment of the present disclosure.

Thus, the method 100 may enable high-quality spatial audio reproduction of a moving acoustic source. Such measurements of a moving acoustic source in the prior art have required an HRTF measured at uniformly high spatial resolution, which is rarely the case due to time/cost issues and peculiarities of each particular measurement setup/process (in particular, the area below the subject, referred to later as the bottom hole, is almost never measured except for some mannequin studies.

Figure 5:
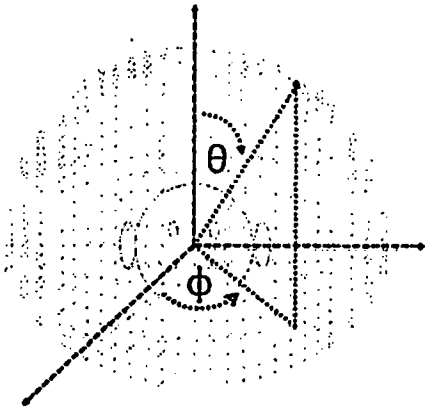
FIG. 5 illustrates a typical HRTF measurement grid of the prior art which may be applied to perform the methods of the present disclosure.

FIG. 5 illustrates a typical HRTF measurement grid which may be employed to implement method 100.

The method 100 proposed herein is a non-parametric, joint spatial-frequency HRTF representation that is well-suited for interpolation and can be easily manipulated. The model established by the method uses prior data (i.e., HRTF measurements) to infer HRTF for a previously unseen location or frequency. While this approach is general enough to consider the HRTF personalization problem, herein it is applied to represent a single-subject HRTF. As described below, the interpolation problem is formulated as a Gaussian process regression (GPR) between the input spatial-frequency coordinate domain $(\omega,\theta,\phi)$ and the output HRTF measurement $H_\omega(\theta,\phi)$.

The GPR approach is non-parametric but does require the specification of a covariance model, which should reflect prior knowledge about the problem. Empirical observations suggest that HRTF generally varies smoothly both over space and over frequency coordinates.

Method 100 representing GPR also enjoys the advantage of automatic model selection via marginal-likelihood optimization using Bayesian inference a feature that other methods do not possess. The method 100 also possesses a natural extension to the automatic extraction of spectral extrema (such as peaks and notches) used in [ICASSP Refs. [14],[2]] for simplifying the HRTF representation. The interpolant is explicitly made smooth as the consequence of smoothness of the spectral basis functions.

The simplest HRTF interpolation methods operate in frequency domain and perform weighted averaging of nearby HRTF measurements [ICASSP Refs. [18],[3], [5]] using the great-circle distance; smoothness constraint is not addressed. More advanced methods are based on spherical splines [ICASSP Refs. [12], [20]]; these methods attempt to fit the data points while keeping the resulting interpolation surface smooth. Other interpolation methods represent HRTF as a series of spherical harmonics [ICASSP Refs. [28], [23]] (which has the advantage of obtaining physically-correct interpolation but is hard to apply in the typical case of bottom-hole measurement grid) or decompose HRTF in the principal component space [ICASSP Refs. [21], [4]] and interpolate the decomposition coefficients over nearby spatial positions. In all of these methods, smoothness over frequency coordinate is not considered.

A recent paper introduced a method of further decomposing the spherical harmonics representation into a series on frequency axis as well, implicitly making the interpolant smooth as the consequence of smoothness of the spectral basis functions. In the GPR method proposed in the current paper, we make the combined spatio-spectral smoothness constraint explicit, derive the corresponding theory, and compare our approach with the ones above in terms of interpolation/approximation error.

Referring again to FIG. 4, the method 100 of Gaussian process regression is applied to head related transfer functions (HRTF) measurement directions 102, in both the $\theta$ and $\Phi$ directions from a collection of HRTFs 104 for at least one subject wherein the individual identity of the subject may be associated with the HRTF 106.

The GP method 100 jointly models N HRTF outputs as an N dimensional jointly normal distribution whose mean and covariance are functions of spherical-coordinate theta ($\theta$), phi ($\Phi$) and frequency inputs. See FIG. 5.

The method 100 includes step 108 of Gaussian process hyper-parameter training wherein for any subset of inputs $X=[x_1, x_N]$, the corresponding vector of function values $f=[f(x_1), f(x_2), f(x_N)]$ has a joint N-dimensional Gaussian distribution that is specified by the prior mean m(x) and covariance $K(x_i,x_j)$ functions $$f(x):GP(m(x),K(x_i,x_j)),m(x)=0,$$

$$K(x_i,x_j)=Cov(f(x_i),f(x_j)).$$

The joint distribution between N training outputs y and N* test outputs $f^*$ under the GP prior is $$\begin{bmatrix} y \\ f_* \end{bmatrix} : N\left(0, \begin{bmatrix} K(X,X)+\sigma^2 I & K(X,X_*) \\ K(X_*,X) & K(X_*,X_*) \end{bmatrix}\right), \tag{3}$$

$$K_{ff} = K(X,X),\ \hat{K} = K_{ff} + \sigma^2 I,$$

$$K_{f^*} = K(X,X_*),\ K_{**} = K(X_*,X_*),$$

where K(X, X) and K(X, X*) are N×N and N×N* matrices of covariances evaluated at all pairs of training and test inputs respectively.

From Eq. 3 and marginalization over the function space f, we derive that the set of test outputs conditioned on the test inputs, training data, and training inputs is a normal distribution given by $$P(f^*|X,y,X^*):N(\bar{f}^*,cov(f^*)),$$

$$\bar{f}^*=E[f^*|X,y,X^*]=K_f^{T}{}^*\hat{K}^{-1}y,$$

$$cov(f^*)=K^{**}-K_f^{T}{}^*\hat{K}^{-1}K_f{}^*. \tag{4}$$

Thus, the interpolant $\bar{f}^*$ for inputs X* in Eq. 4 is computed from the inversion of the covariance matrix $\hat{K}$ specified by the covariance function K, its hyperparameters, and control points (i.e. training outputs y). Model-selection is an $O(N^3)$ runtime task of minimizing the gradient of the negative log-marginal likelihood function with respect to a hyperparameter $\Theta_i$:

$$\log p(y\mid X) = -\frac{1}{2}\left(\log|\hat{K}| + y^T\hat{K}^{-1}y + N\log(2\pi)\right), \tag{5}$$

$$\frac{\partial \log p(y\mid X)}{\partial \Theta_i} = -\frac{1}{2}\left(tr\left(\hat{K}^{-1}P\right) - y^T\hat{K}^{-1}P\hat{K}^{-1}y\right),$$

where $P=\partial\hat{K}/\partial\Theta_i$ the matrix of partial derivatives.

Thus to evaluate the expected value of the interpolant, the expectation of $f^*$ is obtained by solving a linear system. An estimate of the variance may also be obtained.

Figure 6:
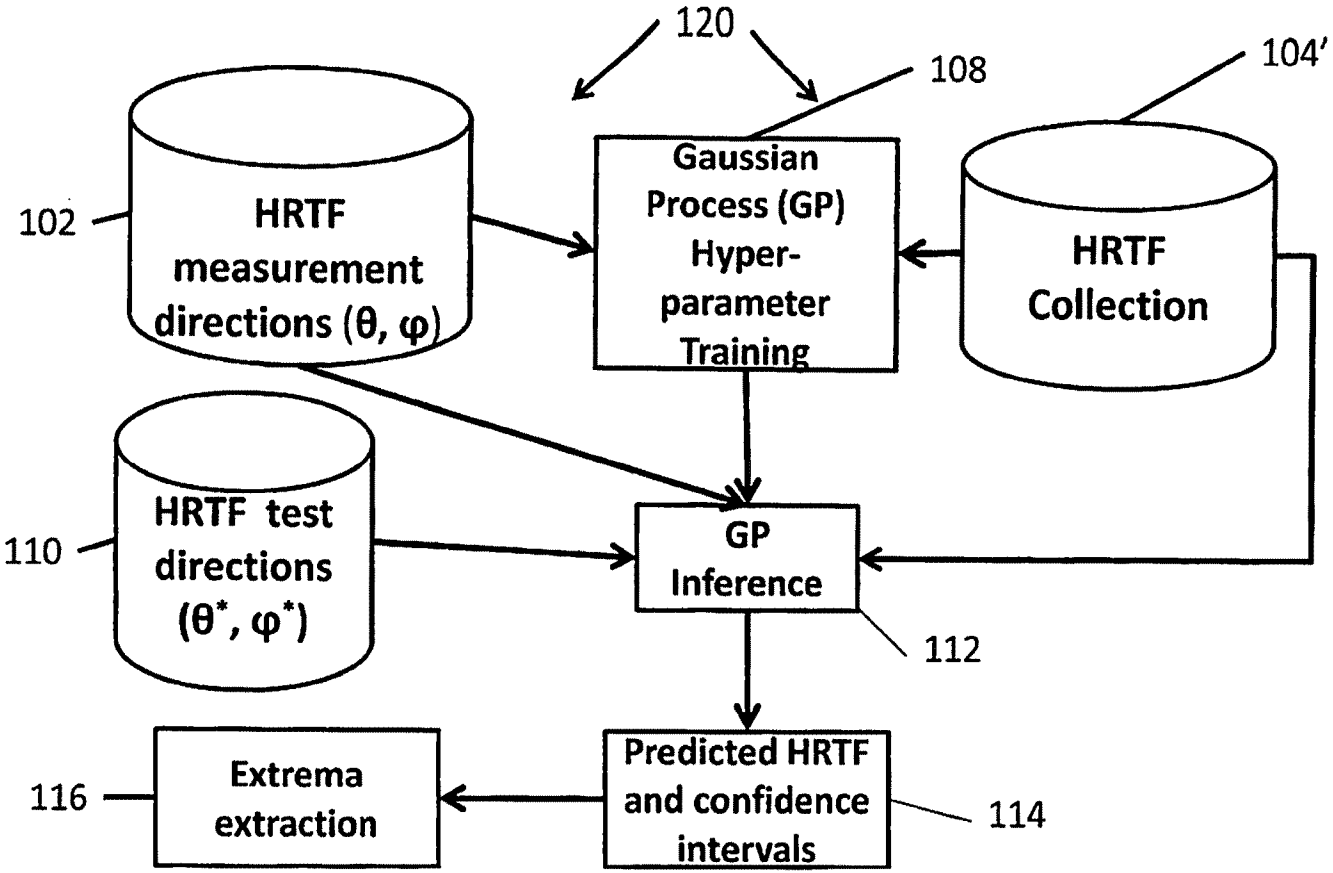
FIG. 6 illustrates a schematic flow chart of the Gaussian process regression method of FIG. 4 wherein the Gaussian process regression method is a sparse Gaussian process regression method as applied to head related transfer functions (HRTF) measurement directions and frequencies from a collection of HRTFs for different subjects according to one embodiment of the present disclosure.

FIG. 6 illustrates a schematic flow chart of an extension of Gaussian process method 100 of FIG. 4 wherein sparse Gaussian process regression method 120 is applied to head related transfer functions (HRTF) measurement directions 102 from a collection of HRTFs for different subjects 104' according to one embodiment of the present disclosure.

HRTF measurement method 120 represents a non-parametric spatial-frequency HRTF representation based on sparse Gaussian process regression (GPR) [ICA Refs. [12], [5]] that addresses problems caused by the cost of solving the Gaussian process regression.

Using sparse GPR one can address the issues caused by each measurement facility seeming to use an individual process to obtain the HRTF—using varying excitation signals, sampling frequencies, and more importantly measurement grids.

Sparse Gaussian process method 120 utilizes prior data (HRTF measurements) 102 to infer HRTFs for previously unseen locations or frequencies for a single-subject. The interpolation problem between the input spatial-frequency coordinate domain $(\omega,\theta,\phi)$ and the output HRTF measurement $H(\omega,\theta,\phi)$ is non-parametric but does require the specification of a covariance model, which should reflect prior knowledge. Empirical observations [ICA Refs. [10],[1]] suggest that the HRTF generally varies smoothly both over space and over frequency. The degree of smoothness is specified by the covariance model; this property also allows us to extract spectral features in a novel way via the derivatives of the interpolant. While method 120 can utilize the full collection of HRTFs belonging to the same subject for inference, it can also specify any subset of frequency-spatial inputs to jointly predict HRTFs at both original and new locations. Learning a subset of predictive HRTF directions as well as covariance function hyperparameters is an automatic process via marginal-likelihood optimization using Bayesian inference—a feature that other methods do not possess. HRTF data from the CIPIC database [ICA Ref. [1]] are used in the interpolation, feature extraction, and importance sampling experiments.

Sparse Grid GP Extension for Importance Sampling

To evaluate the predictive value of the spectral extrema to the original HRTF and to extract prominent directions from the spherical domain, sparse-GPR methods are adopted. A unified framework for sparse-GPR [ICA Ref [5]] is presented as a modification of the joint prior $p(f, f^*)$ that assumes conditional independence between function and predicted values $f$ and $f^*$ given a set of $M \ll N$ inducing inputs $u=[u_1, u_M]^T$ at inducing locations $X^{(u)}$ in the input domain. That is, the inducing pair $(X^{(u)},u)$ represents a sparse set of latent inputs that can be optimized to infer the original data (X,y). One such sparse method is the deterministic training conditional (DTC) where the approximated joint prior $q(y,f^*):p(y,f^*)$, after marginalizing out the inducing inputs u, has the form $$q(y, f_*): N\left(0, \begin{bmatrix} \hat{Q} & Q_{f^*} \\ Q_{*f} & K_{**} \end{bmatrix}\right), \tag{10}$$

$$\hat{Q} = Q_{ff} + \sigma^2 I,\ Q_{ab} = K_{au} K_{uu}^{-1} K_{ub}.$$

The low-rank matrix $Q_{ff}$ in Eq. (10) is computed from M×M and N×M sized matrices $K_{uu}=K(X^{(u)},X^{(u)})$ and $K_{fu}=K(X,X^{(u)})$ that approximates the original Gram matrix $K_{ff}$. For inference, the predictive distribution follows $$\begin{aligned} q(f_* \mid y) &= N\left(Q_{*f}(Q_{ff} + \sigma^2 I)^{-1} y,\ K_{**} - Q_{*f}(Q_{ff} + \sigma^2 I)^{-1} Q_{f^*}\right) \\ &= N(\sigma^{-2} K_{*u} \Sigma K_{uf} y,\ K_{} - Q_{} + K_{*u} \Sigma K_{u^*}), \\ \Sigma &= (\sigma^{-2} K_{uf} K_{fu} + K_{uu})^{-1}, \end{aligned} \tag{11}$$

which is handled in the covariance space spanned by the inducing locations $X^{(u)}$ as represented by matrix $\Sigma$. The sparse log-marginal likelihood function and its gradient with respect to hyperparameter $\Theta_i$ are analogous to Eq. (5) with the approximating matrix $Q_{ff}$ replacing all instances of matrix $K_{ff}$ and reexpressed in terms of matrix $\Sigma$ (see ICA Ref. [6] for the derivation). This allows hyperparameters and inducing locations $X^{(u)}$ (substituted as hyperparameters) to be trained via gradient descent of the objective negative sparse log-marginal likelihood function. Thus, the predictive value of any set of initial locations $X^{(u)}$ can be evaluated; training initial inducing locations set to spectral extrema frequencies (50 iterations) result in tighter prediction. In general, random initializations of the inducing locations converge to lower log-marginal likelihood minima than that of the spectral extrema. The covariance function or step, represented by GP Hyperparameter training 108, may be executed via Kronecker structured Gram matrices. That is, the covariance function is specified by products of kernel functions. e.g. product of a kernel function of spherical-coordinates (and a kernel function of frequency as performed via HRTF test directions (θ*, Φ*) In the more complicated case of a joint spatial-frequency covariance function, the single GP covariance prior for the function f is specified as the product of OU density and exponential covariance function of chordal distance is given by $$K(\theta_i, \theta_j, \phi_i - \phi_j, \omega_i - \omega_j) = \frac{\alpha^2}{\lambda^2 + (\omega_i - \omega_j)^2} e^{-c_{h_{ij}}/\ell^2}, \tag{8}$$

The measurement set as a Cartesian outer-product $X=X^{(\Theta\Phi)}\times X^{(\omega)}$ allows the Gram matrix $K_{ff}$ to be decomposed into Kronecker tensor products $K_{ff}=K_1 \otimes K_2$, where matrices $K_1$ and $K_2$ are covariance evaluations on separate domains $X^{(\Theta\Phi)}$ and $X^{(\omega)}$ respectively.

These specifications of the covariance structure induce a Gram matrix with a Kronecker product structure as per Eq. (9) below.

The inverse covariance matrix with additive white noise is given by the Kronecker product eigendecomposition $$\hat{K}^{-1}=(UZU^T+\sigma^2 I)^{-1}=U(Z+\sigma^2 I)^{-1}U^T,$$

$$K_i=U_i Z_i U_i^T, U=U_1 \otimes U_2, Z=Z_1 \otimes Z_2, \tag{9}$$

which consists of eigendecompositions of smaller covariance matrices $K_i \epsilon R^{m_i \times m_i}$; the total number of samples is $N=\pi_{i=1}{}^2 m_i$. Efficient Kronecker methods [see ICASSP Ref. [17]] reduce costs of inference and hyperparameter training in Eqs. (4) and (5) from $O(N^3)$ to $O(\Sigma_{i=1}{}^2 m_i{}^3+N\Sigma_{i=1}{}^2 m_i)$ and storage from $O(N^2)$ to $O(N+\Sigma_{i=1}{}^2 m_i{}^2)$.

Sparse GP Extension

For tractable inference (inducing locations $X^{(u)}$ are sparse in only the spherical domain), a similar extension is made for matrix $\Sigma$. That is, the Kronecker structure for matrix $\Sigma$ can be preserved via the eigendecomposition of KTP matrices $K_{uu}=UZU^T$ where $U=U_s \otimes U_\omega$ and $Z=Z_S \otimes Z_\omega$ along with a second set of eigendecompositions of KTP matrix $Z^{-1/2}U^T K_{uf} K_{fu} U Z^{-1/2}=\overline{U}\overline{Z}\overline{U}^T$. The matrix $\Sigma$ can now be evaluated as KTPs $$\Sigma=\sigma^2\Omega(\overline{Z}+\sigma^2 I)^{-1}\Omega^T, \Omega=UZ^{-1/2}\overline{U}, \overline{U}=\overline{U}_s \otimes \overline{U}_\omega, \overline{Z}= \overline{Z}_s \otimes \overline{Z}_\Omega, \tag{12}$$

with reduced computational time and storage costs of $O(m_s{}^{(u)2}(m_s{}^{(u)2}+m_s)+m_\omega{}^{(u)2}(m_\omega{}^{(u)}+m_\omega))$ and $O(m_s{}^{(u)}(m_s{}^{(u)}+m_s)+m_\omega{}^{(u)}(m_\omega{}^{(u)}+m_\omega))$ respectively.

Thus, non-parametric models such as Gaussian Process (GP) Regression and sparse-GPR allow Intra-subject HRTFs to infer other intra-subject HRTFs.

Figure 7:
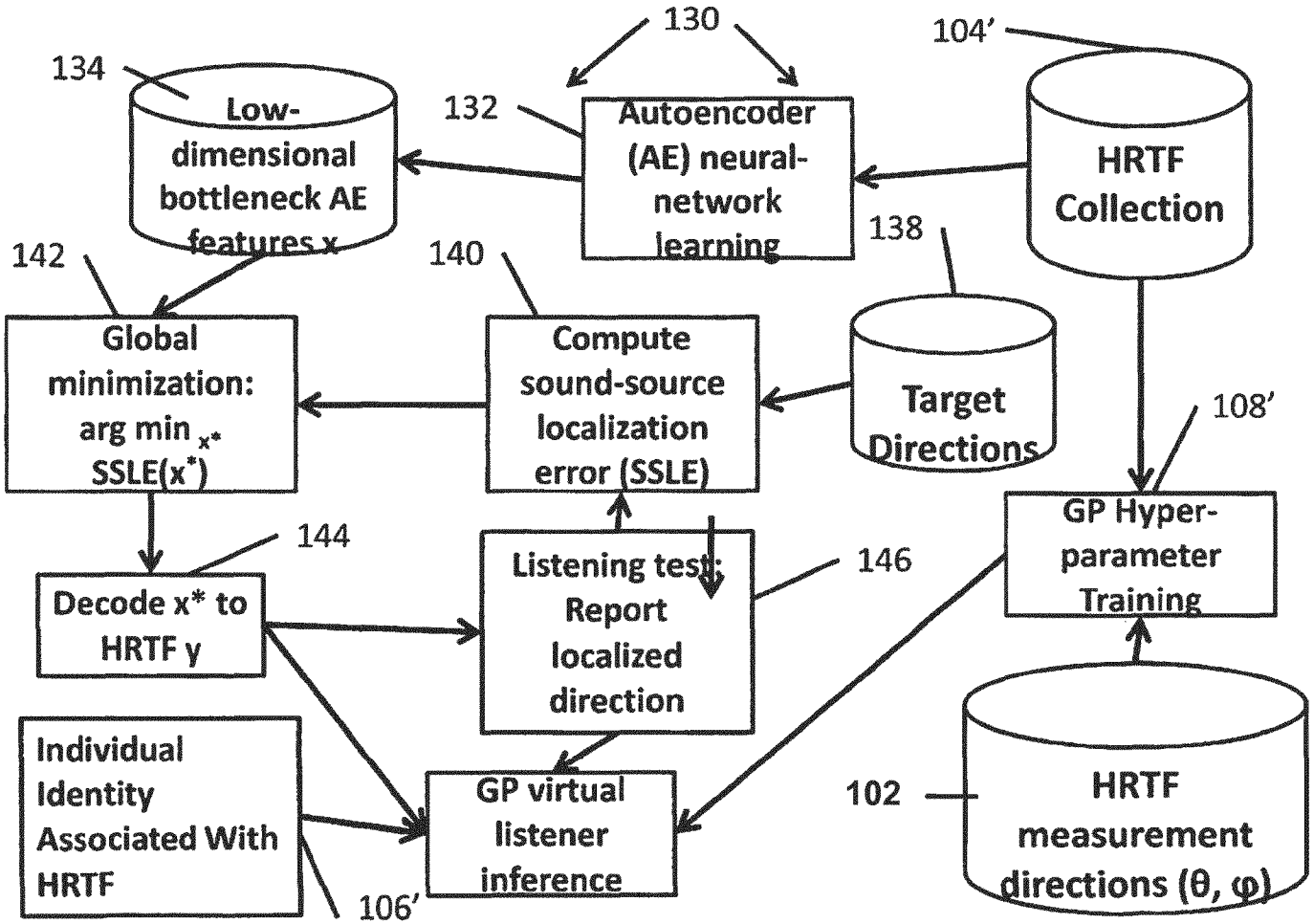
FIG. 7 illustrates a schematic flow chart of the Gaussian process regression method of FIG. 4 as applied to an auto-encoder derived feature-spaces for HRTF personalization without personalized measurements that is accomplished by Gaussian progression virtual listener inference.

FIG. 7 illustrates a schematic flow chart of another extension of Gaussian process method 100 wherein Gaussian process regression method 130 is applied to an auto-encoder derived feature-spaces for HRTF personalization without personalized measurements accomplished by Gaussian progression virtual listener inference.

Autoencoders are auto-associative neural networks that learn low-dimensional non-linear features which can reconstruct the original inputs [see WASSPA.NN Ref. [4]]. This form of dimensionality reduction generalizes PCA given that trained linear-autoencoder weights form a non-orthogonal basis that capture the same total variance as leading PCs of the same dimension. Non-linear autoencoders are a form of kernel-PCA where inputs outside the training set can be embedded into the feature spaces and projected back to the original domain. Multiple autoencoders can be connected layer-wise or stacked to magnify expressive power and denoising autoencoder variants have also been shown to learn more representative features [see WASSPA.NN Ref. [9]].

Low-dimensional PCA representations of HRTFs are often used as targets for regression/interpolation and personalization from predictors such as anthropometry [see WASSPA.NN Refs. [6], [5]]. While PCA captures maximal variance along linear bases, non-linear relationships that are visible in HRTFs such as shifted spectral cues (notches/peaks) and smoothness assumptions along frequency are not represented in the versions synthesized using the linear principal components. Non-linear autoencoders provide a means of learning these properties in an unsupervised fashion, while at the same time achieving superior data compression.

Method 130 is executed by a virtual autoencoder based recommendation system for learning a user's Head-related Transfer Functions (HRTFs) without subjecting a listener to impulse response or anthropometric measurements. When these are available the method can incorporate this information. Autoencoder neural-networks generalize principal component analysis (PCA) and learn non-linear feature spaces that supports both out-of-sample embedding and reconstruction; this may be applied to developing a more expressive low-dimensional HRTF representation. One application is to individualize HRTFs by tuning along the autoencoder feature spaces. To illustrate this, a virtual (black-box) user is developed that can localize sound from query HRTFs reconstructed from those spaces. Standard optimization methods tune the autoencoder features based on the virtual user's feedback. In an actual application user feedback would play the role of the virtual user. Experiments with CIPIC HRTFs show that the virtual user can localize along out-of-sample directions and that optimization in the autoencoder feature space improves upon initial non-individualized HRTFs. Other applications of the representation are also discussed.

Generative Modeling of HRTF

HRTFs can be sampled from low-dimensional autoencoder features (WASPAA NN, pg 2). The basic autoencoder is a three layer neural network composed of an encoder that transforms input layer vector $x \in R^d$ via a deterministic function $f_\Theta(x)$ into a hidden layer vector $y \in R^{d'}$ and a decoder that transforms vector y into the output layer vector $z \in R^d$ via a transformation $g_{\Theta'}(y)$ [see WASSPA.NN Ref [9]]. The aim is to reconstruct $z \approx x$ from the lower-dimensional representation vector y where $d' < d$. The typical neural-network transformation function is given by $$f_\Theta(x)=s(Wx+b), g_{\Theta'}(y)=(W'y+b'), \tag{1}$$

where non-linearity is introduced via the sigmoid activation function $$s(x) = \frac{1}{1+e^{-x}}.$$

Parameters $\Theta=\{W,b\}, \Theta'=\{W',b'\}$ are the weight matrices $W \in R^{d' \times d}, W' \in R^{d \times d'}$ and bias vectors $b \in R^{d'}, b' \in R^d$. They are trained via gradient descent of the reconstruction (mean-squared) error on the training set $X=\{x^{(1)},x^{(N)}\}$ with respect to parameters $\Theta$ and $\Theta'$. We train an autoencoder to find a low-dimensional representation y that has mappings from input HRTF measurements belonging to one or more subjects $H_{\theta,\phi} \in X$ to themselves for spherical coordinates $(\theta,\phi)$.

FIG. 2: Two autoencoders are pre-trained and unrolled into a single deep autoencoder. Samples of non-linear high-level features can decode original HRTFs.

Figure 8:
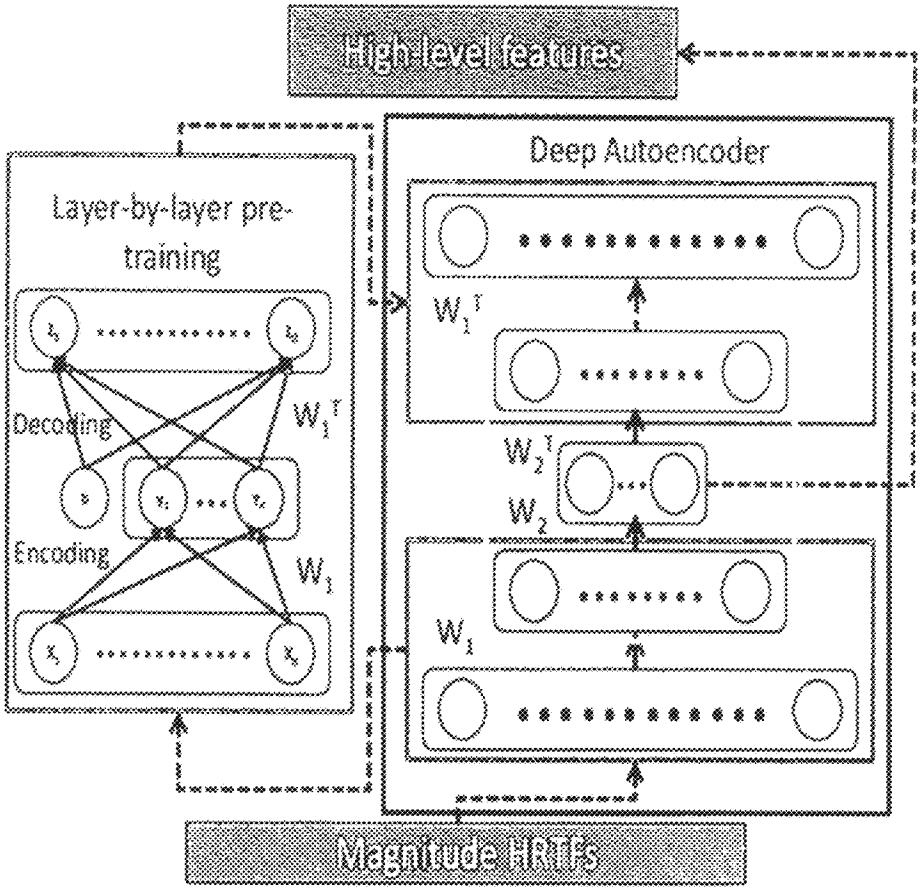
FIG. 8 illustrates the use of deep neural network autoencoders for the purpose of creating low dimensional nonlinear features to encode the HRTF and to decode them from the features.

As illustrated in FIG. 8, Bottleneck features (WASPAA, NN, FIG. 2) are tunable parameters that reconstruct HRTFs.

Figure 9:
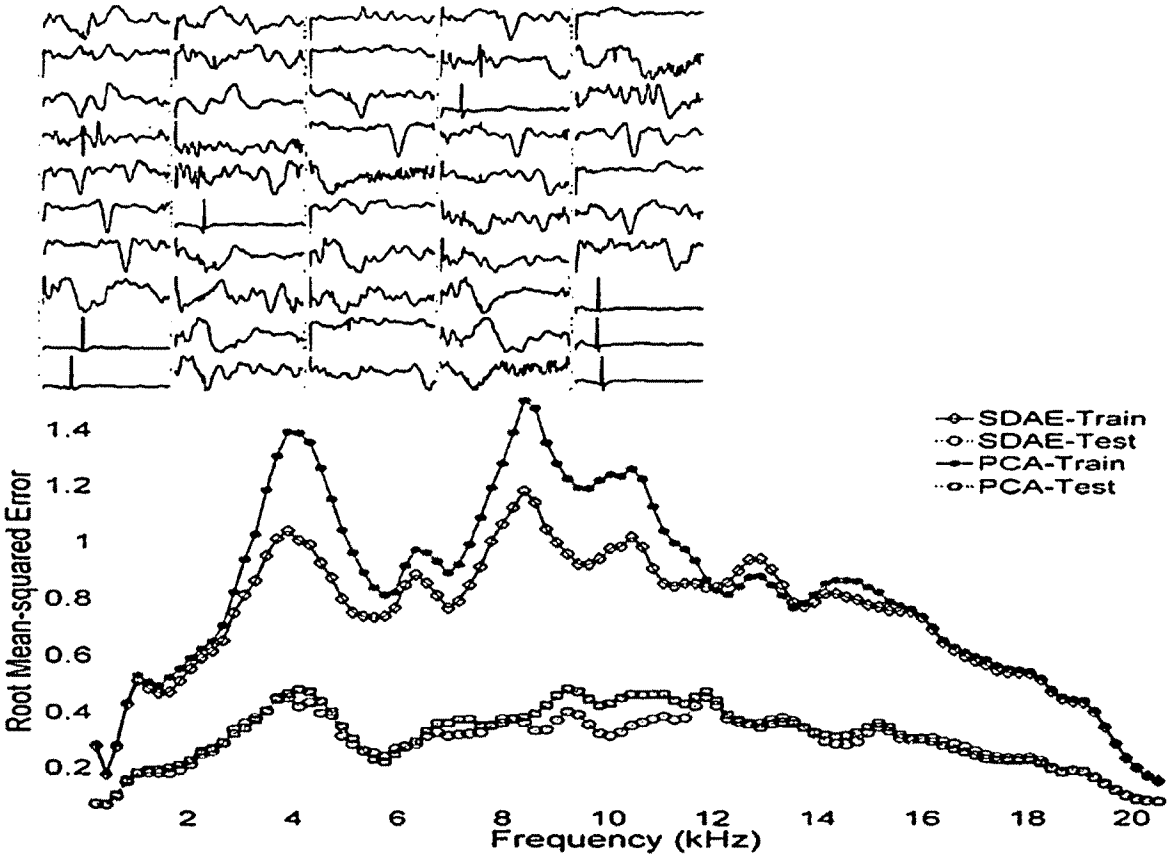
FIG. 9 shows results of the efficiency of encoding HRTFs via the deep neural network with stacked denoising autoencoders (SDAEs) with {100,50,25,2} (inputs-per-autoencoder) in a 7 layer network, which is trained on (30/35) measured subjects HRTFs and compares the reconstruction of the HRTFs using the narrow layer autoencoder features (2 d) with a method from prior art, principal component analysis (PCA) weights (2 d) reconstruct training and out-of-sample HRTF measurements; the comparison done via the SDAE wherein the vertical axis represents the root mean-squared error and the horizontal axis represents the frequency in kHz.

FIG. 9 shows results of the efficiency of encoding HRTFs via the deep neural network with stacked denoising autoencoders (SDAEs) with {100,50,25,2} (inputs-per-autoencoder) in a 7 layer network, which is trained on (30/35) measured subjects HRTFs and compares the reconstruction of the HRTFs using the narrow layer autoencoder features (2 d) with a method from prior art, principal component analysis (PCA) weights (2 d) reconstruct training and out-of-sample HRTF measurements; the comparison done via the SDAE wherein the vertical axis represents the root mean-squared error and the horizontal axis represents the frequency in kHz. As illustrated in FIG. 9, HRTFs decoded from autoencoders give lower training and test errors than that of principal components (WASPAA, NN, FIG. 3).

The denoising autoencoder is a variant of the basic autoencoder that reconstructs the original inputs from a corrupted version. A common stochastic corruption is to randomly zero-out elements in training data X. This forces the autoencoder to learn hidden representation vectors y that are stable under large perturbations of inputs x, which implicitly encodes a smoothness assumption with respect to frequency in the case of HRTF measurement inputs; reconstructed outputs z are therefore smooth curves. This property is useful for HRTF dimensionality reduction where some of the variance due to noise can be ignored to yield better reconstruction errors in FIG. 9.

HRTFs can be sampled from GP posterior normal distributions as in equations (3)-(5) above.

Magnitude HRTFs can be inferred from listening tests by optimizing a low-dimensional parameter space that minimizes sound-source localization error (SSLE).

For a target direction unknown to listener, listener hears a query HRTF, reports sound-source localization direction over GUI, and system computes SSLE with respect to target direction and modifies subsequent query HRTFs.

For simplicity, the virtual user reports only the predicted mean $\bar{f}^*$ from inputs X* as the predicted direction and ignores the predicted variance which measures confidence. Model-selection is an $O(N^3)$ runtime task of minimizing the gradient of the negative log-marginal likelihood function with respect to hyperparameters $\Theta_i$:

$$\log p(y \mid X) = -\frac{1}{2}\left(\log|\hat{K}| + y^T \hat{K}^{-1} y + N\log(2\pi)\right), \tag{W5}$$

$$\frac{\partial \log p(y \mid X)}{\partial \Theta_i} = -\frac{1}{2}\left(tr\left(\hat{K}^{-1}P\right) - y^T \hat{K}^{-1} P \hat{K}^{-1} y\right),$$

where $P=\partial\hat{K}/\partial\Theta_i$ is the matrix of partial derivatives.

To evaluate the user's localization of sound directions outside the database, we specify its GPs over a random subset of available HRTF-direction pairs (1250/3) belonging to CIPIC subject 154's right ear and jointly train all hyperparameters and noise term $\sigma$ for 50 iterations via gradient descent of the log-marginal likelihood in Eq. (W5). The prediction error is the cosine distance metric between predicted direction v and test direction u given by $$dist(u, v) = 1 - \frac{\langle u, v\rangle}{\|u\|\|v\|}, \; u, v \in R^3. \tag{W7}$$

Results indicate better localization near the ipsilateral right-ear directions than in the contralateral direction where clusterings are seen in FIG. 4. Compared to nu-SVR [see WASSPA.NN Ref. [2]] with radial basis function kernel and tuned parameter options, GPR is more accurate because of more expressive parameters and automatic model-selection.

Use global or local optimization methods (e.g. Nelder mead, Quasi-newton) to minimize SSLE with respect to HRTFs generated from 4 or from other generative models (e.g. Gaussian Mixture Model).

Perform listening tests on listener.

The listener predicts sound-source direction (points on sphere) from HRTFs via 3 GPs specified on 3 coordinate axes.

GP jointly models N directions outputs (along same coordinate axis) as an N dimensional normal distribution whose mean and covariance are functions of left and right ear magnitude HRTFs (WASPAA NN, eq. 2-3).

Gaussian Process Regression

To show that this scheme can work, and in the absence of real listener tests, we implement the tests with a virtual user. In the virtual user multiple regression problem, we independently train 3 GPs that predict the Cartesian direction cosines $y=v_i$ from d-dimensional predictor variables $x=H_{\theta,\phi}\in R^d$ given by HRTF measurements of the virtual user. In this Bayesian nonparametric approach to regression, it is assumed that the observation y is generated from an unknown latent function $f(x)$ and is corrupted by additive (Gaussian) noise $$y=f(x)+\epsilon,\epsilon:N(0,\sigma^2), \tag{N2}$$

where the noise term E is zero-centered with constant variance $\sigma^2$. Placing a GP prior distribution on the latent function $f(x)$ enables inference and enforces several useful priors such as local smoothness, stationarity, and periodicity. For any subset of inputs $X=[x_1, x_N]$, the corresponding vector of function values $f=[f(x_1), f(x_2), f(x_N)]$ has a joint N-dimensional Gaussian distribution that is specified by the prior mean m(x) and covariance $K(x_i,x_j)$ functions given by $$f(x):GP(m(x),K(x_i,x_j)),m(x)=0,$$

$$K(x_i,x_j)=cov(f(x_i),f(x_j)). \tag{N3}$$

For N training outputs y and N* test outputs $f^*$, we define the Gram matrix $\hat{K}=K_{ff}+\sigma^2 I$ as the pair-wise covariance evaluations between training and test predictors given by matrices $K_{ff}=K(X,X)\in R^{N\times N}$, $K_f^*=K(X,X^*)\in R^{N\times N^*}$, and $K^{**}=K(X^*,X^*)\in R^{N^*\times N^*}$.

GP covariance function is specified as product of Matern class covariance functions over each frequency in Eq. (N6).

For the choice of covariance, we consider the product of stationary Matérn v=3/2 functions for each of the d independent variables $r_{ijk}=|x_{ik}-x_{jk}|$ given by $$K(x_i, x_j) = \prod_{k=1}^{d}\left(1+\frac{\sqrt{3}\,r_{ijk}}{\ell_k}\right)e^{-\frac{\sqrt{3}\,r_{ijk}}{\ell_k}}, \tag{N6}$$

where $l_k$ is the characteristic length-scale hyperparameter for the $k^{th}$ predictor variable. This covariance function outperforms other Matérn classes $v=\{1/2,5/2,\infty\}$ in terms of data marginal-likelihood and prediction error in experiments.

New sound-source directions at test input HRTFs given known directions and known input HRTFs are normally distributed (posterior distribution), (eq. N4 below)

GP inference is a marginalization over the function space f, which expresses the set of test outputs conditioned on the test inputs, training data, and training inputs as a normal distribution $P(f^*|X,y,X^*):N(\bar{f}^*,cov(f^*))$ given by $$\bar{f}^*=E[f^*|X,y,X^*]=K_f^{T*}\hat{K}^{-1}y,$$

$$cov(f^*)=K^{**}-K_f^{T*}\hat{K}^{-1}K_f^*. \tag{N4}$$

More particularly, method 130 includes accessing HRTF collection 104" to provide a data base of HRTFs for auto-encoder (AE) neural network (NN) learning in step 132. Based on the learning occurring in step 132, low-dimensional bottleneck AE features x are generated. X represents all the HRTF measurements (or as the case may be, features)—the prediction uses these. This section describes the virtual user implementation.

In addition, target directions are generated in step 138 and in step 140, the sound-source localization error (errors(s)?) (SSLE) is calculated. Together with the low-dimensional bottleneck AE features x generated in step 134, in step 142, the SSLE computed in step 140 is accounted for in a global minimization of the argument, i.e., arg $\min_{x^*}$ SSLE(x*).

Step 144 includes decoding x* to $HRTF_y$. Step 146 includes performing a listening test utilizing $HRTF_y$ and reporting a localized direction as feedback input to step 140 to recompute the SSLE and re-perform step 142 of global minimization of arg $\min_{x^*}$ SSLE(x*).

In step 106', the identity of the individual is associated with $HRTF_y$

Returning to the step of accessing HRTF collection 104", step 108' includes Gaussian process hyper-parameter training that is executed in a similar manner to the Gaussian process hyper-parameter training described above with respect to step 108. The Gaussian process hyper-parameter training of step 108 is performed utilizing the HRTF measurement directions (θ, Φ) input in step 102'. The results of the Gaussian process hyper-parameter training of step 108, the $HRTF_y$ decoded in step 114, the localized direction reported in step 146 and the individual identity associated with the $HRTF_y$ in step 106' are input in step 148 to generate a Gaussian process listener inference.

Figure 10:
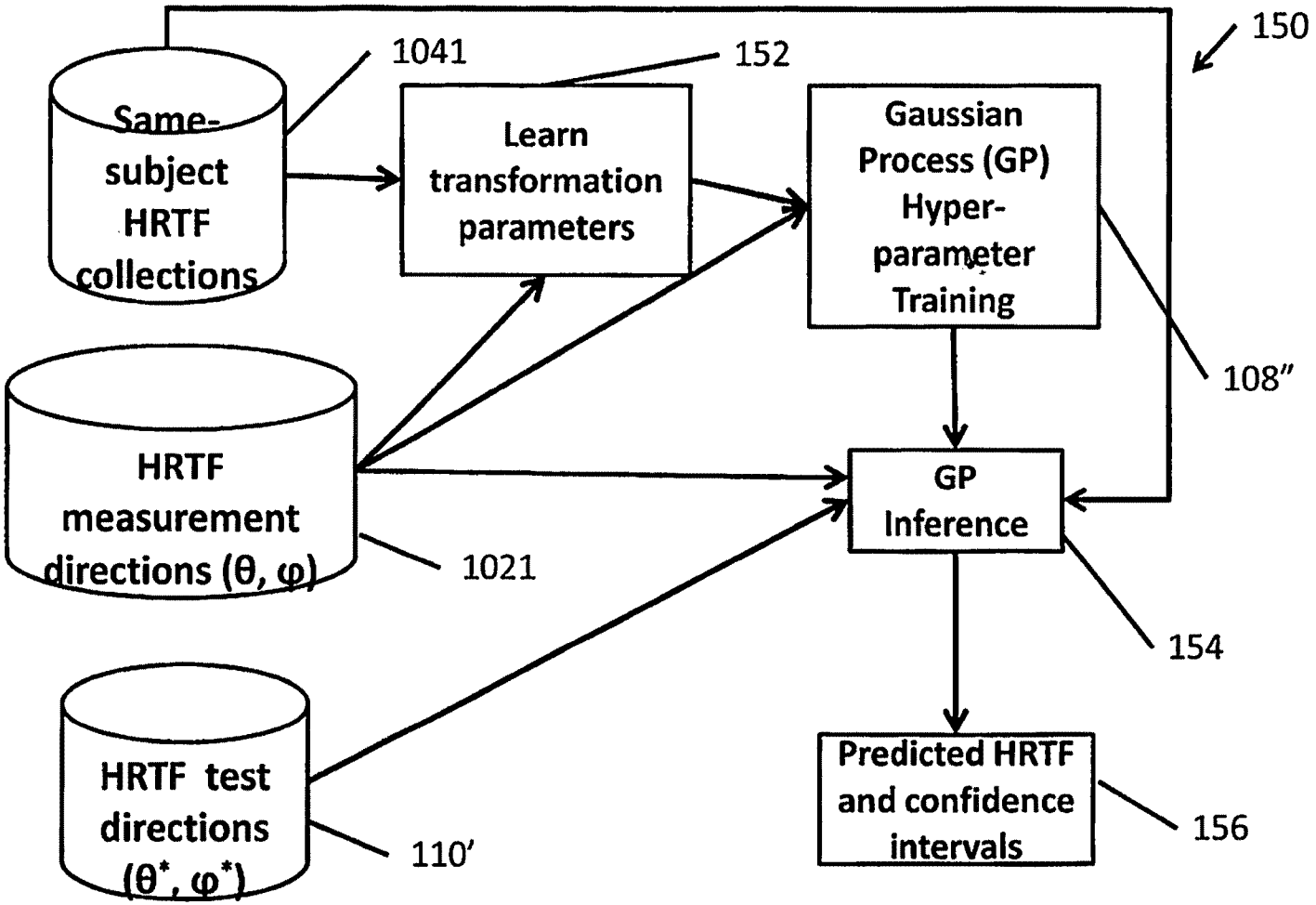
FIG. 10 illustrates a schematic flow chart of the Gaussian process regression method of FIG. 4 as applied to HRTF measurement directions from a collection of HRTFs for the same subject according to one embodiment of the present disclosure.

FIG. 10 illustrates a schematic flow chart of another extension of Gaussian process regression method 100 wherein Gaussian process regression method 150 is applied to HRTF measurement directions from a collection of HRTFs for the same subject according to one embodiment of the present disclosure.

Using 1, intra-subject HRTFs (datasets) collected from different apparatuses can be combined.

HRTFs are preprocessed to share same frequency 44100 kHz via up/down sampling.

Distortions arising from measurement processes between HRTF datasets can be learned.

Set one dataset of HRTFs as constant.

Learn transformation filter weights for all other datasets that maximize log-marginal likelihood criterion via gradient descent (see Eq. W5).

Formally, let function $g_t(y)$ with parameters $\Theta^{\{t\}}$ transform the observation-vector y for fixed-observations $y^{\{t\}}$ and input-vector X. If GP prior mean and covariance functions are specified over a latent function $f_t$ with isotropic noise over transformed observations $g_t(y)$, then the data-likelihood of $g_t(y)$ is the probability of having been drawn from the modified joint-prior normal distribution. The related negative log-marginal likelihood objective function and its partial derivatives with respect to covariance hyper-parameter $\Theta_i^{\{K,t\}}$ and transform-parameters $\Theta_i^{\{t\}}$ are given by $$-L_t = \frac{1}{2}\left(\log|\hat{K}| + g_t(y)^T\gamma + N\log(2\pi)\right), \tag{W5}$$

$$-\frac{\partial L_t}{\partial \Theta_i^{\{K,t\}}} = \frac{1}{2}\left(tr\left(\hat{K}^{-1}\frac{\partial \hat{K}}{\partial \Theta_i^{\{K,t\}}}\right) - \gamma^T\frac{\partial \hat{K}}{\partial \Theta_i^{\{K,t\}}}\gamma\right),$$

$$-\frac{\partial L}{\partial \Theta_i^{\{t\}}} = \gamma^T\frac{\partial g_t(y)}{\partial \Theta_i^{\{t\}}},\ \gamma = \hat{K}^{-1}g_t(y).$$

The closed-form derivatives provide automatic model-selection and transform-parameter learning by gradient descent methods. Several transform-functions $g_t$ with physical interpretations are considered.

Transformation is a composition of equalization (WASPAA WARP, eq. 6-8) and window transforms of datasets.

Window-Transform

The window-transform simulates windowing in the time-domain via a symmetric Toeplitz-matrix vector product in the direction-frequency domain given by $$g_t(y) = bdg[\Phi_t^{\{1\}}, \Phi_t^{\{t-1\}}, I_{N_t}, \Phi_t^{\{t+1\}}, \Phi_t^{\{T\}}]y,$$

$$\Phi_t^{\{i\}} = Tp(\Theta^{\{t,i,1\}}) \otimes \mathrm{Tp}\ (\Theta^{\{t,i,2\}}), \tag{W9}$$

where bdg[$A_1$, $A_2$] generates a block-diagonal matrix with diagonal elements as square matrices $A_1$, $A_2$ and 0's off-diagonal. Task-independent transformations $\Phi_t^{\{i\}}$ are Kronecker products of symmetric-Toeplitz matrices $\mathrm{Tp}(a)_{jk} = a_{|j-k|+1}$ generated from weights (parameters) $\Theta^{\{t,i,1\}}$, and $\Theta^{\{t,i,2\}}$ Optimizing parameters with respect to the objective function $L_t$ can be interpreted as learning a set of discrete and symmetric point-spread functions from sources to target datasets. The partial derivatives $u = \partial g_t(y)/\partial\Theta_j^{\{t,i,1\}}$ and $v = \partial g_t(y)/\partial\Theta_j^{\{t,i,2\}}$ are given by $$u = bdg\left[0_{N_1}, , 0_{N_{t-1}}, \frac{\partial \Phi_t^{\{i\}}}{\partial \Theta_j^{\{t,i,1\}}}, 0_{N_{t+1}}, , 0_{N_T}\right]y, \tag{W10}$$

$$v = bdg\left[0_{N_1}, , 0_{N_{t-1}}, \frac{\partial \Phi_t^{\{i\}}}{\partial \Theta_j^{\{t,i,2\}}}, 0_{N_{t+1}}, , 0_{N_T}\right]y,$$

where $0_{N_i} \epsilon R^{N_i \times N_i}$ is the zero-matrix, $\partial\Phi_t^{\{i\}}/\partial\Theta_j^{t,i,1} = \mathrm{Tp}(e_j) \otimes \mathrm{Tp}(\Theta^{\{t,i,2\}})$ and $\partial\Phi_t^{\{i\}}/\partial\Theta_j^{t,j,1} = \mathrm{Tp}(\Theta^{\{t,i,1\}}) \otimes \mathrm{Tp}(e_j)$. The local minimum has the closed-form expression, which allows multiple parameters to quickly converge during joint-optimization. Thus, inter-subject, inter-lab HRTFs can be statistically compared by applying transformations weights to HRTFs datasets.

More particularly, method 150 includes step 1041 of accessing a database collection of HRTF for the same individual or subject. Step 152 includes, based on the foregoing description, accessing from database 1021 HRTF measurement directions (θ, Φ) and step 1041 of accessing the database collection of HRTF for the same individual or subject, learning the transformation parameters or filter weights that maximize log-marginal likelihood criterion via gradient descent.

In a similar manner as described above with respect to steps 108 and 108', step 108" includes of Gaussian process hyper-parameter training based in receiving from the output of step 152 the learned transformation parameters or filter weights and accessing from database 1021 HRTF measurement directions (θ, Φ).

Step 154 of Gaussian process inference is implemented by accessing the database collection of HRTF for the same individual or subject in step 1041, accessing from database 1021 HRTF measurement directions (θ, Φ), and implementation of step 110' of accessing a database of HRTF test directions (θ*, Φ*).

The Gaussian process inference in step 154 then enables step 156 of generating predicted HRTF and confidence intervals.

The detailed description of exemplary embodiments herein makes reference to the accompanying drawings, which show the exemplary embodiments by way of illustration and their best mode. While these exemplary embodiments are described in sufficient detail to enable those skilled in the art to practice the disclosure, it should be understood that other embodiments may be realized and that logical and mechanical changes may be made without departing from the spirit and scope of the disclosure. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

LIST OF REFERENCES

ICASSP

Yuancheng Luo, Dmitry N. Zotkin, Hal Daumé III and Ramani Duraiswami, "Kernel Regression for Head-Related Transfer Function Interpolation and Spectral Extrema Extraction", Proceedings 38th International Conference on Acoustics, Speech, and Signal Processing (ICASSP), Vancouver, 2013.

REFERENCES CITED IN ICASSP

[1] V. R. Algazi, R. O. Duda, and C. Avendano, "The CIPIC HRTF Database," in *IEEE Workshop on Applications of Signal Processing to Audio and Acoustics*, New Paltz, N.Y., 2001, pp. 99-102.

[2] V. R. Algazi, C. Avendano, and R. O. Duda, "Elevation localization and head-related transfer function analysis at low frequencies," *Journal of the Acoustical Society of America*, vol. 109, pp. 1110-1122, 2001.

[3] D. R. Begault, "3D sound for virtual reality and multimedia," Academic Press, Cambridge, Mass., 1994.

[4] J. Cheng, B. D. Van Veen, and K. E. Hecox, "A spatial feature extraction and regularization model for the head related transfer function," *Journal of Acoustical Society of America*, vol. 97, pp. 439-452, 1995.

[5] F. P. Freeland, L. Wagner, P. Biscainho, and P. R. Dinz, "Efficient HRTF interpolation in 3D moving sound," in *AES 22nd International Conference,* 2002, pp. 106-114.

[6] T. Gneiting, "Correlation functions for atmospheric data analysis," *Quarterly Journal of the Royal Meteorological Society*, vol. 125, pp. 2449-2464, 1999.

[7] C. Huang, H. Zhang, and S. M. Robeson, "On the validity of commonly used covariance and variogram functions on the sphere," *Mathematical Geosciences*, vol. 43, pp. 721-733, 2011.

[8] J. Kayser and C. E. Tenke, "Principal components analysis of Laplacian waveforms as a generic method for identifying ERP generator patterns: I. Evaluation with auditory oddball tasks," *Clinical Neurophysiology, vol.* 117, pp. 348-368, 2006.

[9] F. Keyrouz and K. Diepold, "A rational HRTF interpolation approach for fast synthesis of moving sound," in 12*th Digital Signal Processing Workshop and* 4*th Signal Processing Education Workshop,* 2006, pp. 222-226.

[10] D. J. Kistler and F. L. Wightman, "A model of head-related transfer functions based on principal components analysis and minimum-phase reconstruction," *Journal of Acoustical Society of America*, vol. 91, pp. 1637-1647, 1992.

[11] A. Kulkarni, S. K. Isabelle, and H. S. Colburn, "Sensitivity of human subjects to head-related transfer-function phase spectra," *Journal of the Acoustical Society of America*, vol. 105, pp. 2821-2840, 1999.

[12] F. Perrin, J. Pernier, O. Bertrand, and J. F. Echallier, "Spherical splines for scalp potential and current density mapping," *Electroencephalography and Clinical Neurophysiology*, vol. 72, pp. 184-7, 1989.

[13] C. E. Rasmussen and C. Williams, *Gaussian Processes for Machine Learning*, MIT Press, Cambridge, Massachusettes, 2006.

[14] V. C. Raykar, R. Duraiswami, and B. Yegnanarayana, "Extracting the frequencies of the pinna spectral notches in measured head related impulse responses," *Journal of Acoustical Society of America*, vol. 118, pp. 364-374, 2005.

[15] M. Riedmiller, "RPROP: Description and implementation details," Tech. Rep., University of Karlsruhe, 1994.

[16] S. M. Robeson, "Spherical methods for spatial interpolation: Review and evaluation," *Cartography and Geographic Information Science*, vol. 24, pp. 3-20, 1997.

[17] Y. Saatci, *Scalable Inference for Structured Gaussian Process Models*, Ph.D. thesis, University of Cambridge, 2011.

[18] L. Savioja, J. Huopaniemi, T. Lokki, and R. Väänänen, "Creating interactive virtual acoustic environments," *Journal of the Audio Engineering Society*, vol. 47, pp. 675-705, 1999.

[19] G. E. Uhlenbeck and L. S. Ornstein, "On the theory of Brownian motion," *Phys. Rev*, vol. 36, pp. 823-841, 1930.

[20] G. Wahba, "Spline interpolation and smoothing on the sphere," *SIAM Journal on Scientific Statistical Computing*, vol. 2, pp. 5-16, 1981.

[21] L. Wang, F. Yin, and Z. Chen, "Head-related transfer function interpolation through multivariate polynomial fitting of principal component weights," *Acoustical Science and Technology*, vol. 30, pp. 395-403, 2009.

[22] A. M. Yaglom, "Correlation theory of stationary and related random functions vol. I: Basic results," *Springer Series in Statistics*. Springer-Verlag, 1987.

[23] W. Zhang, M. Zhang, R. A. Kennedy, and T. D. Abhayapala, "On high-resolution head-related transfer function measurements: An efficient sampling scheme," *IEEE Transactions on Audio, Speech, and Language Processing*, vol. 20, pp. 575-584, 2012.

[24] W. Zhang, R. A. Kennedy, and T. D. Abhayapala, "Efficient continuous HRTF model using data independent basis functions: Experimentally guided approach," *IEEE Transactions on Audio, Speech, and Language Processing*, vol. 17, pp. 819-829, 2009.

[25] W. Zhang, R. A. Kennedy, and T. D. Abhayapala, "Iterative extrapolation algorithm for data reconstruction over sphere," in *IEEE International Conference on Acoustics, Speech, and Signal Processing* (*ICASSP*), 2008, pp. 3733-3736.

[26] D. N. Zotkin, R. Duraiswami, and L. S. Davis, "Rendering localized spatial audio in a virtual auditory space," *IEEE Transactions on Multimedia*, vol. 6, pp. 553-564, 2004.

[27] R. Duraiswami, D. N. Zotkin, and N. A. Gumerov, "Interpolation and range extrapolation of HRTFs," in *IEEE International Conference on Acoustics, Speech, and Signal Processing* (*ICASSP*), Montreal, QC, Canada, 2004, vol. 4, pp. 45-48.

[28] D. N. Zotkin, R. Duraiswami, and N. A. Gumerov, "Regularized HRTF fitting using spherical harmonics," in *IEEE Workshop on Applications of Signal Processing to Audio and Acoustics,* 2009, pp. 257-260.

ICA

Yuancheng Luo, Dmitry N. Zotkin, and Ramani Duraiswami, "Statistical Analysis of Head-Related Transfer Function (HRTF) data", International Congress on Acoustics, Montreal, accepted, Proceedings of Meetings on Acoustics, 2013.

REFERENCES CITED IN ICA

[1] V. R. Algazi, R. O. Duda, and C. Avendano, "The CIPIC HRTF Database", in *IEEE Workshop on Applications of Signal Processing to Audio and Acoustics,* 99-102 (New Paltz, N.Y.) (2001).

[2] V. R. Algazi, C. Avendano, and R. O. Duda, "Elevation localization and head-related transfer function analysis at low frequencies", Journal of the Acoustical Society of America 109, 1110-1122 (2001).

[3] J. Blauert, *Spatial hearing: the psychophysics of human sound localization* (MIT Press, Cambridge, Massachusettes) (1997).

[4] Z. Botev, J. Grotowski, and D. Kroese, "Kernel density estimation via diffusion" Annals of Statistics 38, 2916-2957 (2010).

[5] J. Quinonero-Candela and C. E. Rasmussen, "A unifying view of sparse approximate Gaussian process regression", Journal of Machine Learning Research 6, 1939-1959 (2005).

[6] J. Quinonero-Candela, "Learning with uncertainty—Gaussian processes and relevance vector machines", Ph.D. thesis, Technical University of Denmark (2004).

[7] G. Grindlay and M. Vasilescu, "A multilinear (tensor) framework for HRTF analysis and synthesis", in *IEEE ICASSP* (2007).

[8] J. Kayser and C. E. Tenke, "Principal components analysis of Laplacian waveforms as a generic method for identifying ERP generator patterns: I. Evaluation with auditory oddball tasks.", Clinical Neurophysiology 117, 348-368 (2006).

[9] D. J. Kistler and F. L. Wightman, "A model of head-related transfer functions based on principal components analysis and minimum-phase reconstruction", Journal of Acoustical Society of America 91, 1637-1647 (1992).

[10] A. Kulkarni and H. S. Colburn, "Role of spectral detail in sound-source localization", Nature 396, 747-749 (1998).

[11] A. Kulkarni, S. K. Isabelle, and H. S. Colburn, "Sensitivity of human subjects to head-related transfer-function phase spectra", Journal of the Acoustical Society of America 105, 2821-2840 (1999).

[12] C. E. Rasmussen and C. Williams, *Gaussian Processes for Machine Learning* (MIT Press, Cambridge, Massachusettes) (2006).

[13] V. C. Raykar, R. Duraiswami, and B. Yegnanarayana, "Extracting the frequencies of the pinna spectral notches in measured head related impulse responses", Journal of Acoustical Society of America 118, 364-374 (2005).

[14] S. M. Robeson, "Spherical methods for spatial interpolation: Review and evaluation", Cartography and Geographic Information Science 24, 3-20 (1997).

[15] Y. Saatci, "Scalable inference for structured Gaussian process models", Ph.D. thesis, University of Cambridge (2011).

[16] B. Silverman, *Density Estimation for Statistics and Data Analysis* (Chapman and Hall/CRC, London) (1998).

[17] G. E. Uhlenbeck and L. S. Ornstein, "On the theory of Brownian motion", Phys. Rev 36, 823-841 (1930).

[18] E. M. Wenzel and S. H. Foster, "Perceptual consequences of interpolating head-related transfer functions during spatial synthesis", in *IEEE Workshop on Applications of Signal Processing to Audio and Acoustics* (1993).

[19] W. Zhang, R. A. Kennedy, and T. D. Abhayapala, "Iterative extrapolation algorithm for data reconstruction over sphere", in *IEEE ICASSP,* 3733-3736 (2008).

[20] R. Duraiswami, D. N. Zotkin, and N. A. Gumerov, "Interpolation and range extrapolation of HRTFs", in *IEEE ICASSP*, volume 4, 45-48 (Montreal, QC, Canada) (2004).

[21] D. N. Zotkin, R. Duraiswami, and N. A. Gumerov, "Regularized HRTF fitting using spherical harmonics", in *IEEE Workshop on Applications of Signal Processing to Audio and Acoustics,* 257-260 (2009).

WASPAA NN

Yuancheng Luo, Dmitry N. Zotkin, and Ramani Duraiswami. "Virtual Autoencoder based Recommendation System for Individualizing Head-related Transfer Functions", IEEE Workshop on Applications of Signal Processing to Audio and Acoustics (WASPAA), 2013, New Paltz, N.Y.

REFERENCES CITED IN WASPAA.NN

[1] V. R. Algazi, R. O. Duda, and C. Avendano, "The CIPIC HRTF Database," in *IEEE Workshop on Applications of Signal Processing to Audio and Acoustics*, New Paltz, N.Y., 2001, pp. 99-102.

[2] C.-C. Chang and C.-J. Lin, "LIBSVM: A library for support vector machines," *ACM Transactions on Intelligent Systems and Technology*, vol. 2, pp. 27:1-27:27, 2011.

[3] K. Fink and L. Ray, "Tuning principal component weights to individualize HRTFs," in *ICASSP,* 2012.

[4] G. Hinton and R. Salakhutdinov, "Reducing the dimensionality of data with neural networks," *Science*, vol. 313, no. 5786, pp. 504-507, 2006.

[5] H. Hu, L. Zhou, H. Ma, and Z. Wu, "HRTF personalization based on artificial neural network in individual virtual auditory space," *Applied Acoustics*, vol. 69, no. 2, pp. 163-172, 2008.

[6] Q. Huang and Y. Fang, "Modeling personalized head-related impulse response using support vector regression," *J Shanghai Univ* (*Engl Ed*), vol. 13, no. 6, pp. 428-432, 2009.

[7] R. B. Palm, "Prediction as a candidate for learning deep hierarchical models of data," Master's thesis, Technical University of Denmark, DTU Informatics, 2012.

[8] C. E. Rasmussen and C. Williams, *Gaussian Processes for Machine Learning.* 1em plus 0.5em minus 0.4em Cambridge, Massachusettes: MIT Press, 2006.

[9] P. Vincent, H. Larochelle, I. Lajoie, Y. Bengio, and P.-A. Manzagol, "Stacked denoising autoencoders: Learning useful representations in a deep network with a local denoising criterion," *Journal of Machine Learning*, vol. 11, pp. 3371-3408, December 2010.

[10] E. M. Wenzel, M. Arruda, D. J. Kistler, and F. L. Wightman, "Localization using nonindividualized head-related transfer functions," *JASA*, vol. 94, p. 111, 1993.

[11] D. Zotkin, J. Hwang, R. Duraiswaini, and L. S. Davis, "HRTF personalization using anthropometric measurements," in *Applications of Signal Processing to Audio and Acoustics,* 2003 *IEEE Workshop on.* 1em plus 0.5em minus 0.4em Ieee, 2003, pp. 157-160.

WASPAA WARP

Yuancheng Luo, Dmitry N. Zotkin, and Ramani Duraiswami, "Gaussian Process Data Fusion for Heterogeneous HRTF Datasets", IEEE Workshop on Applications of Signal Processing to Audio and Acoustics (WASPAA), 2013, New Paltz, N.Y.

REFERENCES CITED IN WASPAA.WARP

[1] B. F. G. Katz and D. R. Begault, "Round robin comparison of HRTF measurement system: preliminary results," in *Proceedings of ICA,* 2007.

[2] Y. Luo, D. N. Zotkin, H. Daumé III, and R. Duraiswami, "Kernel regression for head-related transfer function interpolation and spectral extrema extraction," in *ICASSP,* 2013.

[3] C. E. Rasmussen and C. Williams, *Gaussian Processes for Machine Learning.* 1em plus 0.5em minus 0.4em Cambridge, Massachusettes: MIT Press, 2006.

[4] Y. Saatci, "Scalable inference for structured Gaussian process models," Ph.D. dissertation, University of Cambridge, 2011.

[5] G. E. Uhlenbeck and L. S. Ornstein, "On the theory of Brownian motion," *Phys. Rev*, vol. 36, pp. 823-841, 1930.

[6] D. Zotkin, R. Duraiswami, and L. S. Davis, "Rendering localized spatial audio in a virtual auditory space," *IEEE Transactions on Multimedia*, vol. 6, pp. 553-564, 2004.

The invention claimed is:

1. A system for generating and outputting three-dimensional audio data using head-related transfer functions (HRTFs), the system comprising:

a tangible, non-transitory memory communicating with a processor, the tangible, non-transitory memory having instructions stored thereon that, in response to execution by the processor, cause the processor to perform operations comprising:

using a collection of previously measured HRTFs for audio signals corresponding to multiple directions for at least one subject;

performing non-parametric Gaussian process hyper-parameter training on the collection of previously measured HRTFs to generate one or more predicted HRTFs that are different from the previously measured HRTFs; and generating and outputting three-dimensional audio data based on at least the one or more predicted HRTFs.

2. The system according to claim 1, wherein the operation of performing Gaussian process hyper-parameter training on the collection of HRTFs further comprises causing the processor to perform operations that include:

applying sparse Gaussian process regression to perform the Gaussian process hyper-parameter training on the collection of HRTFs.

3. The system of claim 2, wherein the one or more predicted HRTFs are HRTFs for test directions not part of an original set of said multiple directions, and the method further comprises causing the processor to calculate a confidence interval for the one or more predicted HRTFs.

4. The system of claim 3, further comprising causing the processor to perform an operation that includes:

extracting extrema data from the one or more predicted HRTFs.

5. The system according to claim 1, further comprising causing the processor to perform an operation that includes:

accessing the collection of HRTFs to provide a data base of HRTF for autoencoder (AE) neural network (NN) learning; and learning an AE NN based on the collection of HRTFs accessed; and generating low-dimensional bottleneck AE features.

6. The system of claim 5, further comprising causing the processor to perform an operation that includes:

generating target directions;

computing sound-source localization errors reflecting an argument; and accounting for the sound-source localization errors in a global minimization of the argument of the sound-source localization errors (SSLE).

7. The system of claim 6, further comprising causing the processor to perform an operation that includes:

decoding the argument of the sound-source localization errors to the one or more predicted HRTFs.

8. The system of claim 7, further comprising causing the processor to perform an operation that includes:

performing a listening test utilizing the one or more predicted HRTFs;

reporting a localized direction as feedback input;

recomputing the SSLE; and re-performing the global minimization of the argument of the SSLE.

9. The system of claim 8, further comprising causing the processor to perform an operation that includes:

generating a Gaussian process listener inference based upon the steps of decoding of the argument of the SSLE to the one or more predicted HRTFs, performing the listening test utilizing the one or more predicted HRTFs, and reporting the localized direction as feedback input.

10. The system of claim 1, wherein the method further comprises causing the processor to perform operations that include:

receiving HRTF measurements from different sources, and creating the one or more predicted HRTFs based on said HRTF measurement from different sources.

11. The system of claim 10, further comprising causing the processor to perform an operation that includes:

accessing a database HRTFs for the same individual in multiple directions; and accessing a database of HRTF test directions.

12. The system of claim 11, further comprising causing the processor to perform an operation that includes:

based on the accessing steps, implementing Gaussian process inference.

13. The system of claim 12, further comprising causing the processor to perform an operation that includes:

calculating confidence intervals for the one or more predicted HRTFs.

14. A method for generating and outputting three-dimensional audio data using head-related transfer functions (HRTF), the method comprising:

collecting audio signals in a transform domain for at least one subject;

applying head related transfer functions in multiple directions to the collected audio signals;

performing non-parametric Gaussian hyper-parameter training on the collection of HRTFs to generate one or more predicted HRTFs; and generating and outputting three dimensional audio data based at least on the one or more predicted HRTFs.

15. The method according to claim 14, further comprising causing the processor to perform an operation that includes:

identifying an individual associated with the one or more predicted HRTFs.

16. The method according to claim 15, wherein the step of performing Gaussian hyper-parameter training on the collection of HRTFs further comprises applying sparse Gaussian process regression to perform the Gaussian hyper-parameter training on the collection of HRTFs.

17. The method according to claim 16, further comprising:

applying HRTF test directions; and inferring Gaussian progression virtual listener measurements.

18. The method according to claim 17, further comprising:

calculating a confidence interval for the one or more predicted HRTFs.

19. The method according to claim 18, further comprising:

extracting extrema data from the predicted HRTFs.

* * * * *